United States Patent [19]

Györy

[11] 4,038,700

[45] Aug. 2, 1977

[54] SAFETY HELMETS FOR MOTORCYCLISTS OR THE LIKE

[76] Inventor: Kálmán Györy, Ahrwaldstr. 7, 3141 Garlstorf a. Walde, Germany

[21] Appl. No.: 695,115

[22] Filed: June 11, 1976

[30] Foreign Application Priority Data

June 12, 1975 Germany ..... 2526336

[51] Int. Cl.[2] ..... A42B 3/02

[52] U.S. Cl. ..... 2/413

[58] Field of Search ..... 2/410–415, 2/425

[56] References Cited

U.S. PATENT DOCUMENTS

| | | | |
|---|---|---|---|
| 3,039,109 | 6/1962 | Simpson | 2/413 |
| 3,447,163 | 6/1969 | Bothwell et al. | 2/412 |
| 3,548,410 | 12/1970 | Parker | 2/10 X |
| 3,616,463 | 11/1971 | Theodore et al. | 2/412 |
| 3,761,959 | 10/1973 | Dunning | 2/413 |
| 3,787,893 | 1/1974 | Larcher | 2/413 |
| 3,818,508 | 6/1974 | Lammers et al. | 2/412 |
| 3,849,801 | 11/1974 | Holt et al. | 2/413 |
| 3,873,997 | 4/1975 | Gooding | 2/413 |

*Primary Examiner*—Alfred R. Guest
*Attorney, Agent, or Firm*—Fleit & Jacobson

[57] ABSTRACT

A safety helmet for motorcyclists or the like including a hard shell having a lining of flexible material behind which are disposed a plurality of air cushions interconnected by means of tubes provided with pressure equalization delay devices to provide a yielding engagement by the lining with the enclosed parts of the face and skull together with air-foil-like projections on the outer surface of the shell acted upon by an airstream to reduce the weight of the helmet.

3 Claims, 5 Drawing Figures

SAFETY HELMETS FOR MOTORCYCLISTS OR THE LIKE

BACKGROUND OF THE INVENTION

Safety helmets such as are used in industrial safety helmets or as crash helmets for motorcyclists consist in essence, of a hard outer shell of metal or rigid plastic with an insert of semi-rigid foamed plastic such as polystyrene foam and glued to the inside of the foam insert, a lining of leather, flexible plastic, or textile material. This flexible inner lining is commonly backed with a layer of soft foam padding some 5–12mm thick made, for example, of foam rubber.

For economic reasons, such safety helmets are manufactured in only a limited number of head sizes, namely so-called "double sizes", i.e., sizes intended to fit two adjacent head sizes. In order to improve the fit of such industrial safety helmets, which is naturally only very approximate, on the head of the wearer, consideration has already been given to the possibility of attaching, beneath the foam-padded lining of the industrial safety helmet so that it extends over the helmet's inner surface, an inflatable rubber or plastic cushion, the variable degree of inflation of which is intended to produce the desired adjustment to the head size.

This adjustment of the fit may in general be sufficient in the case of an industrial safety helmet. However, the adjustment is still not ideal for motorcycle helmet construction, since in the case of motorcycle helmets, the requirements regarding precision of fit are considerably higher than for industrial safety helmets.

With motorcycle helmets, it is far more important than with industrial safety helmets that they should be not only easy to put on but also and above all, easy to take off, particularly with regard to the possibility of accidents involving injury to the head or neck. This requirement could be met comparatively easily by selecting a relatively loose fit. However, since it is very important that motorcycle helmets, unlike industrial safety helmets, should also sit firmly on the wearer's head in order reliably to prevent their slipping from the correct position as a result of wind pressure especially at high speeds, this solution cannot be used here. For the same reason, merely adjusting the helmet to the wearer's head size is not sufficient for a really ideal fit in this case either. What would be desirable, in addition to this, is the closest possible individual adjustment of the internal shape of the helmet to the various head shapes of the wearers which, of course, comprise a much larger number of possible variations than mere head sizes, something which is not possible with helmets of the kind known hitherto.

In the case of the best of the motorcycle helmets known today, the so-called integral helmets, it is of crucial importance that these requirements should be met. Integral helmets cover not only the wearer's cranium and temporal regions but also the entire head including the face, leaving only an aperture in front of the face which is expediently closed by a transparent windscreen. Since such helmets must closely surround all parts of the head including the chin they are not at all easy to remove especially for unskilled laymen which can cause considerable problems in the event of injury to the wearer.

SUMMARY OF THE INVENTION

It is an object of the present invention to provide a safety helmet which is especially suitable for use as a motorcycle helmet and which need only be manufactured in quite a small number of standardised sizes and which can quickly and easily be adjusted to fit not merely a wide variety of head sizes but in fact every possible shape of head and face in question.

It is a further object of the present invention to provide a safety helmet which can, if the need arises, be removed quickly and extremely gently from the head of even a severely injured person by even a completely unskilled layman.

It is a further object of the present invention to provide a safety helmet which, although at least equal to the best integral helmets in the protection it affords, produces a marked reduction in the weight borne by the head of its wearer and thereby substantially lessens the risk of accident due to wearer fatigue.

The first two objects are accomplished according to the invention by virtue of the fact that the interior of the helmet, which is preferably padded with foam in essentially known fashion, is fitted with several independent air cushions which surround all parts of the face and skull contained within the helmet with the exception of the chin and lie against them without intervening rigid parts.

The accomplishment of the last object according to the invention, is fundamentally due to the arrangement on the helmet of projections or protusions having an effect akin to that of an airfoil and on which the airstream exerts an upward force which causes an equivalent reduction in the weight borne by the head of the wearer.

Although the aforementioned cushions could admittedly be provided with separate inflation valves, according to a preferred development of the invention, they are all connected with one another by means of tubes in such a way that the entire system can be inflated and deflated through a single inflation valve. The separate layout of the various air cushions, especially those protecting the cheeks, the cranium, and the back of the neck, permits a far more precise automatic adjustment of the air cushion system to not only the size but also the shape of the head of the wearer for the time being than would be possible with a single, continuous cushion. Thus by means of inflation after the helmet has been put on, it is possible to adjust the helmet so precisely to the shape of the wearer's head that it sets firmly on the head without being unpleasantly tight. Despite its precise and close fit, the helmet can be removed extremely gently and without difficulty in the minimum of time once the air has been let out of the air cushions as is absolutely essential in the event of an accident involving injury to the head or neck. According to a further preferred development of the invention, the connections between the individual cushions are furnished with delay devices which prevent an excessively rapid drop in pressure in the event of damage to an individual cushion. If an individual cushion suffers impact or other damage in the event of an accident, the elasticity of this individual cushion is thereby sustained for those extra seconds which are crucial to the effectiveness of the additional protection afforded by the elasticity of the air cushion. Such delay devices can take the form of valves or constrictions inhibiting the equalisation of pressure between the individual cushions, or, in the simplest case, they could be open-pored foam rubber or foam plastic plugs inserted in the connecting tubes.

The other benefits of helmet inserts with inflatable air cushions which can be achieved even with a single air cushion insert or with systems made up of several independent air cushions contained between two undeformable shells, namely additional protection for the head afforded by the elasticity of the air cushion, and insulation against heat and cold, are naturally preserved undiminished in the insert with several air cushions which is the subject of the invention.

BRIEF DESCRIPTION OF THE DRAWINGS

A more detailed schematic explanation of the invention with reference to the drawings is given by way of example below.

DESCRIPTION OF THE PREFERRED EMBODIMENTS

Figure 1:
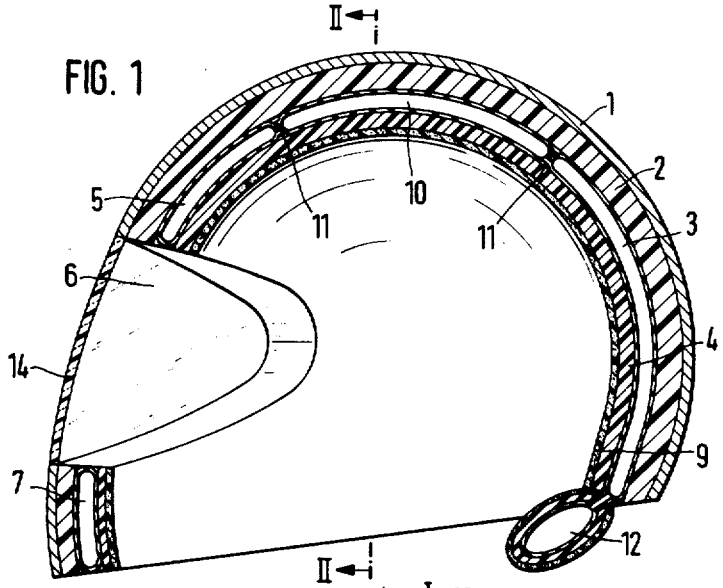
FIG. 1 is a vertical sectional view taken along the line I — I of FIG. 2 in the direction of the arrows.
Figure 2:
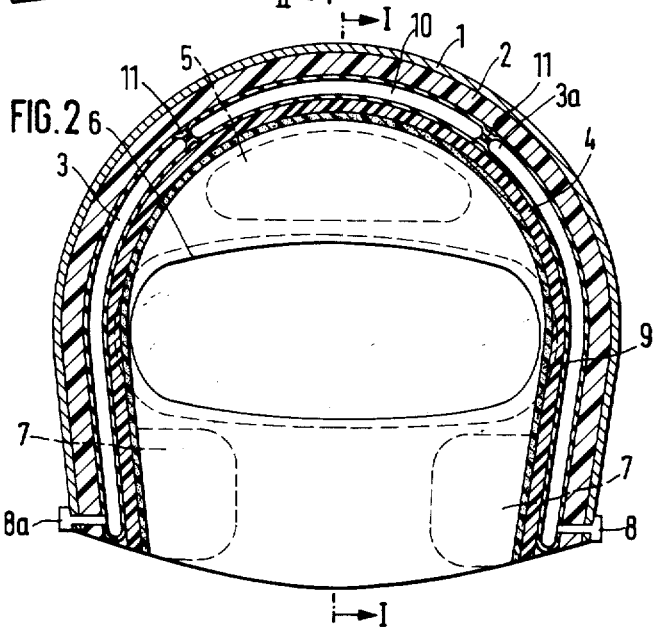
FIG. 2 is a sectional view taken along line II — II of FIG. 1 in the direction of the arrows.

The hard shell 1 of the helmet of the invention preferably formed of metal or plastic such as ABS (acrylonitrile butadiene styrene copolymer) or fibreglass or glass-reinforced plastic is lined in essentially known fashion with a semi-rigid foam insert 2, made for example of Styropor (expanded polystyrene). The shell is provided with a flexible lining 4 of leather, textile material or flexible plastic with a backing of soft plastic foam 9. The shell 1 is provided with an aperture 6 in front of the face which is expediently closed by means of a transparent windscreen 14. The system of inflatable air cushions 3, **3*a*, 5, 7 and 10, which are preferably connected with one another by means of connecting tubes 11, is located on the inside of the foam insert 2**.

Figure 3:
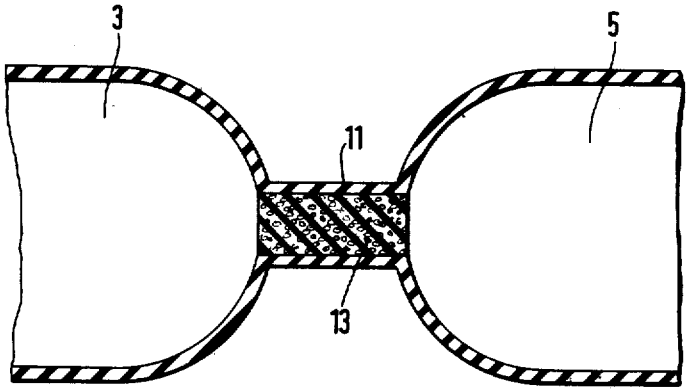
FIG. 3 is an enlarged sectional view taken through the connecting tubes between the individual air cushions together with the pressure equalisation delay devices located in the tubes.

In particular, 3 is the cushion for the back of the head, 5 the cushion for the forehead, **3*a* the two cushions for the temples. 7 the two cushions for the cheeks, 10 the cushion for the cranium, and 12 the support for the back of the neck. As can be seen from the drawings, this means that all parts of the skull and the face with the exception of the chin are enclosed by air cushions which lie practically directly against them because the soft foam padding 9 and the likewise flexible lining 4 adjust completely to any changes in the shape of the air cushions. Pressure equalisation delay devices are fitted in the connecting tubes 11, being in the simplest case tightly fitting foam-rubber plugs with open pores, as depicted schematically in FIG. 3. The air cushions are provided with an inflation valve 8, which is also used for deflating the air cushions. If desired, the deflating of the air cushions can be made easier and faster by the provision of further valves of which only the valve 8*a*** is depicted by way of example in the drawings.

Figure 4:
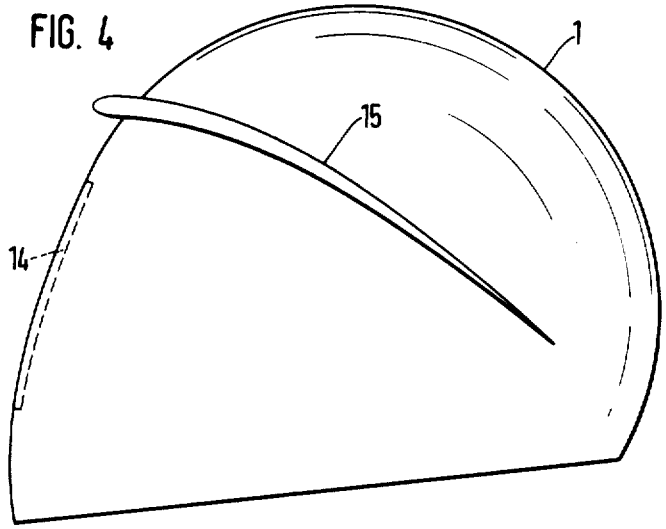
FIG. 4 is the side elevation view of a preferred embodiment of the helmet according to the invention with airfoil-like projections which owing to the upward force exerted by the airstream cause a reduction in the weight of the helmet.
Figure 5:
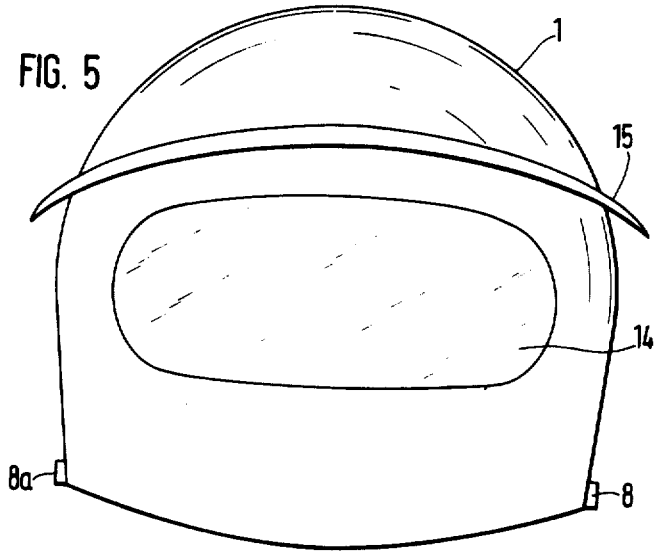
FIG. 5 is a front view of the helmet of FIG. 4.

The arrangement of the airfoil-like projections 15, owing to the upward force exerted by the airstream, cause a reduction in the weight of the helmet can be seen from FIGS. 4 and 5. They can either be fabricated at the same time and in the same operation as the manufacture, by injection moulding for example, of the outer shell 1 of the helmet or manufactured separately and joined to the outer shell 1 in a subsequent operation.

The dimensions and configuration of these projections 15 are to be chosen in accordance with the known laws of aerodynamics such that the upward force is practically negligible at speeds of up to approximately 50 kilometers per hour and reaches 100% of the weight of the helmet, generally some 1.5 to 1.8 kg, at whatever is felt to be the maximum permissible speed, for example, at approximately 200–250 kilometers per hour.

Naturally, a large number of variants are possible within the limits set by these maximum and minimum requirements. Experience shows that preference should be given those variations in which the aerodynamically produced upward force is equivalent to 40–60% of the weight of the helmet at the common average speed of approximately 100–120 kilometers per hour.

Although the upward force exerted by the air stream depends not only on the speed at which the wearer is travelling and the shape and dimensions of the projections but also on the attitude of the helmet wearer's head, the described preferred embodiment of the invention is based on a recognition of the fact that at the speeds which normally come into consideration, practically all motorcyclists adopt the same attitude of the head and that even the few exceptions who prefer a different attitude of the head when wearing other helmets, automatically change the attitude of their head in such a way as to achieve an optimum reduction in the weight of the helmet when they are wearing a helmet with the airfoil-like projections which are preferred according to the invention.

It is claimed:

1. A safety helmet for enclosing the entire head and extending below the chin of a motorcyclist of the type having a hard outer shell with a semi-hardened foam lining and having a viewing aperature in the front thereof, comprising a plurality of inflatable interconnected air cushions arranged interior to said helmet such that a first cushion protects the neck, a second and third cushion protect the cheeks and a fourth cushion protects the top of the cranium, and wherein interconnecting of said cushions is achieved by air conduits each having located therein a pressure drop delay means whereby upon rupturing one of said air cushions a rapid release of inflation of all air cushions is prevented.

2. The helmet of claim 1 wherein said pressure drop delay means comprises a plug formed of plastic foam having substantially open pores.

3. The helmet of claim 1 further comprising a valve means communicating with said plurality of inflatable air cushions for regulating the air pressure in said cushions and for releasing all air pressure upon opening said valve means.

* * * * *